US011780616B2

(12) United States Patent
Morral Roca

(10) Patent No.: US 11,780,616 B2
(45) Date of Patent: Oct. 10, 2023

(54) MACHINE FOR AUTOMATICALLY MAKING A POUCH TYPE CONTAINER

(71) Applicant: MESPACK, SL, Barcelona (ES)

(72) Inventor: Jose Morral Roca, Barcelona (ES)

( * ) Notice: Subject to any disclaimer, the term of this patent is extended or adjusted under 35 U.S.C. 154(b) by 143 days.

(21) Appl. No.: 17/493,522

(22) Filed: Oct. 4, 2021

(65) Prior Publication Data

US 2022/0106065 A1 Apr. 7, 2022

(30) Foreign Application Priority Data

Oct. 5, 2020 (EP) ..... 20382881

(51) Int. Cl.

| | |
|---|---|
| ***B65B 9/02*** | (2006.01) |
| ***B65B 41/10*** | (2006.01) |
| ***B65B 61/06*** | (2006.01) |
| ***B65B 43/50*** | (2006.01) |
| ***B65B 51/22*** | (2006.01) |
| ***B65B 57/00*** | (2006.01) |
| ***B65B 65/00*** | (2006.01) |

(52) U.S. Cl.

CPC ..... *B65B 9/023* (2013.01); *B65B 41/10* (2013.01); *B65B 43/50* (2013.01); *B65B 51/225* (2013.01); *B65B 57/00* (2013.01); *B65B 61/06* (2013.01); *B65B 65/006* (2013.01)

(58) Field of Classification Search

None

See application file for complete search history.

(56) References Cited

U.S. PATENT DOCUMENTS

| | | | | |
|---|---|---|---|---|
| 3,225,667 A * | 12/1965 | Fuchs | B31B 50/326 493/59 |
| 4,353,198 A * | 10/1982 | Koppe | B65B 43/465 53/570 |
| 6,520,899 B1 * | 2/2003 | Haggman | B29C 53/42 493/126 |
| 2002/0152720 A1 * | 10/2002 | Kinigakis | B29C 66/849 53/133.4 |
| 2003/0195651 A1 * | 10/2003 | Cherfane | B29B 7/7433 53/139.5 |

FOREIGN PATENT DOCUMENTS

WO WO-2014206687 A1 * 12/2014 ..... B31B 1/00

* cited by examiner

*Primary Examiner* — Tanzim Imam

(74) *Attorney, Agent, or Firm* — Eugenio J. Torres-Oyola; Victor M. Rodriguez-Reyes; Rafael Rodriguez-Muriel

(57) ABSTRACT

Comprises a flexible band feeding unit (10); a positioning unit (14) to position and fix on the flexible band (12) some first functional elements (3); a flexible band cross-cutting unit (16) providing cut sheets pieces (17) with a first functional element (3) fixed to it; a station (18) configured to shape the container by folding a cut sheet piece (17) including a supporting rod (22) with retention means of the cut sheet piece; a station (19) welding lateral sides of the folded cut sheet piece (17) forming the container (2) with un upper non-sealed edge and a station (20) transferring the formed container (2) to a line configured for filling a dosed product into the container (2) and closing the non-sealed edge of the container (2).

12 Claims, 4 Drawing Sheets

MACHINE FOR AUTOMATICALLY MAKING A POUCH TYPE CONTAINER

TECHNICAL FIELD

The present invention is directed to the sector of the machinery for automatically manufacturing pouch type containers made of a laminar material, sealed by its periphery the laminar material being obtained from a flexible band.

STATE OF THE ART

U.S. Pat. No. 5,826,401 discloses a machine for automatically forming, filling, and closing bags made from a flexible film. The machine includes means suitable for generating at least onefold associated with the film that is to constitute a bag, so as to form at least one gusset in the final bag.

DE102014210234 discloses a device for producing pouch packs that it can be used for at least two different pouch packs without having to convert the device for this purpose. In particular, it should be made possible to process differently printed packaging material webs so that by means of appropriate metering devices, bag packs with different products o product mixtures can be generated.

WO2015042505 relates to a method of making bottom-gusseted packages, comprising the steps of providing a flexible web of material having a longitudinal axis, providing a flexible, sleeve-forming web; cutting said flexible, sleeve-forming web into a plurality of individual sleeves; joining said individual sleeves to said flexible web in spaced apart relationship longitudinally of said flexible web, with the spacing between said individual sleeves corresponding to the length of each of said bottom-gusseted packages being formed; folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web; and cutting said folded flexible web at intervals each corresponding in length to said length of each of said bottom-gusseted packages so each individual sleeve provides a bottom gusset for one of the packages being formed.

U.S. Pat. No. 5,840,189 discloses a beverage filter that includes an impermeable imperforate hollow base closed at one end and having an access opening at the opposite end, with a self-supporting filter element permanently joined to an interior surface of the base. The filter is configured and dimensioned to divide the base into first and second chambers. A beverage extract is stored in the first chamber. An impermeable and imperforate cover is permanently joined in a hermetically sealed relationship to the base to close the access opening. Both the cover and base are yieldable pierceable, the cover to accommodate an injection of liquid into the first chamber for combination with the extract to produce a beverage, and the base to accommodate the outflow of the beverage from the second chamber.

The present invention provides a machine devised to automatically manufacture a pouch type container from a laminar material based on the teachings of cited stated of the art by further attaching to said laminar material some additional functional elements and transferring cut-sheet pieces of said laminar material with the attached functional elements to a container forming station including several successive stations that form a container with an unsealed edge departing from said cut-sheet pieces, holding the laminar parts forming the container duly positioned during the container formation, and without movement, and transferring a container with an upper unsealed edge to a line configured for filling a dosed product into the container and sealing it.

BRIEF DESCRIPTION OF THE INVENTION

To this aim the present invention provides a machine for manufacturing pouch type containers made of a laminar material such as described above (for example a plastic film) including some additional wall elements.

The machine of this invention in a basic embodiment comprises:

- a flexible band feeding unit adapted to convey a tensioned flexible band from a supply roller and passing it through a series of support parallel rollers in a conveyance direction following a conveyance path;
- a first positioning unit configured to position on the flexible band first functional elements of the container, arranging these first functional elements in a spaced position relationship along the flexible band, and further including a unit adapted to fix, e.g., by thermo welding or ultrasonic welding, the first functional elements on the flexible band;
- a flexible band cross-cutting unit, adapted to perform cuts across the flexible band providing rectangular cut sheet pieces each including one first functional element;
- a shaping station including a supporting rod that is equipped with retention means that hold a folded cut sheet;
- a feeding station adapted to transfer and release cut sheet pieces from the flexible band cross-cutting unit to the shaping station;
- a welding station configured to weld lateral sides of the cut sheet piece after it has been shaped into a container, keeping an upper non-sealed edge; and
- a transfer station adapted to transfer the formed container with said upper non-sealed edge to a line adapted for opening said upper non-sealed edge of the container, filling a dosed product into the container and finally closing the upper non-sealed edge of the container.

According to this invention the shaping station and the welding station are arranged along a path of a transport unit that includes a plurality of supporting rods, each supporting rod having associated retention means of the cut sheet pieces forming the container and the transport unit being adapted to move the rods along said path from one to another of the cited shaping station and welding station until reaching the transfer station.

In a further embodiment the machine further comprises a second positioning unit adapted to further position and fix to the flexible band second functional elements of the container separated with regard to the first functional elements The referred first and second functional elements are attached to the upper surface of the tensioned flexible band so that after folding of the cut sheet piece they are included within the container.

According to a preferred embodiment a portion of the cited supporting rod is surrounded by a sleeve including a plurality of holes connected to a vacuum source adapted to provide a suction through them to hold the cut sheet piece, and the subsequently shaped container while it is being moved in the transport unit to the welding station.

In a preferred embodiment the cited transport unit is a rotary unit that includes a plurality of the cited rods and perforated sleeves, adapted to move them (with the cut sheet piece forming the container retained around the cited perforated sleeve) from one to another of the cited stations.

It will be understood that references to geometric position, such as parallel, perpendicular, tangent, etc. allow deviations up to ±5° from the theoretical position defined by this nomenclature. It will also be understood that any range of values given may not be optimal in extreme values and may require adaptations of the invention to these extreme values are applicable, such adaptations being within reach of a skilled person.

BRIEF DESCRIPTION OF THE FIGURES

The foregoing and other advantages and features will be more fully understood from the following detailed description of an embodiment with reference to the accompanying drawings, to be taken in an illustrative and non-limitative manner, in which.

DETAILED DESCRIPTION OF AN EMBODIMENT

Figure 1:
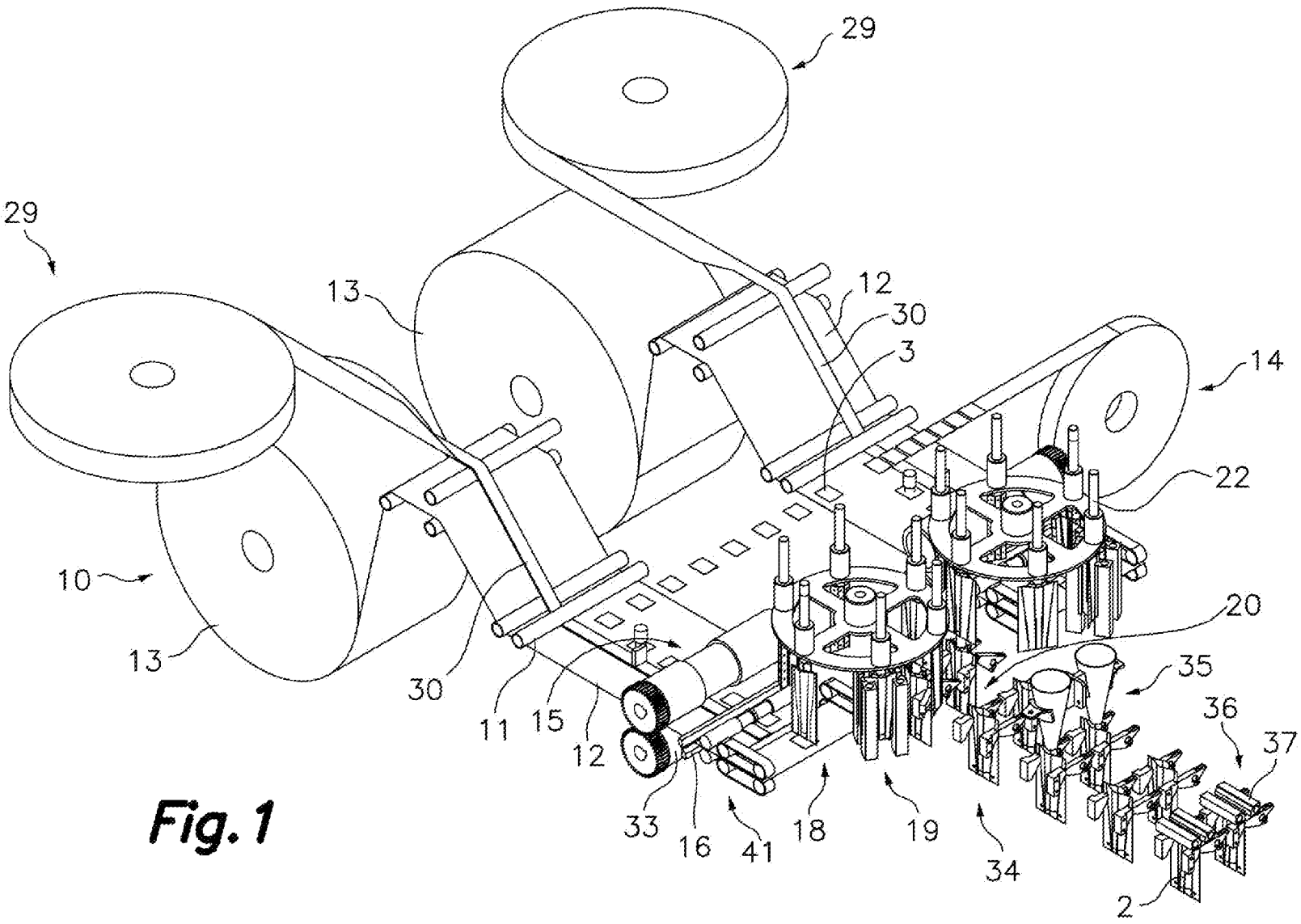
FIG. 1 is a is a perspective, schematic view of a machine according to the principles of the present invention. More precisely in this illustrative example two machines according to this invention are arranged in parallel forming a single assembly, the two machines operating in a coordinated manner in connection with a single exit line adapted for opening, filling, closing and delivery of the containers to a storage area.

FIG. 1 illustrates the basic features of a machine 1 for manufacturing pouch type containers 2 made of a laminar material, sealed by its periphery.

As can be seen in this FIG. 1 the proposed machine comprises:

- a flexible band feeding unit 10 adapted to convey a flexible band 12 from a supply roller 13 in a conveyance direction passing through a series of supporting rollers 11;
- a first positioning unit 14 configured to position on the flexible band 12 some first functional elements 3, arranging these elements 3 in a predetermined position across the flexible band 12 and further including a unit 15 adapted to fix the elements 3 on the flexible band 12;
- a flexible band cross-cutting unit 16, configured to perform cut sheets across the flexible band 12, providing rectangular cut sheets pieces 17 including one first functional element 3 fixed to it;
- a shaping station 18 configured to shape a container 2, from the cut sheet pieces equipped with a supporting rod 22 that is equipped with retention means that hold a folded cut sheet piece (17);
- a feeding station 41 adapted to transfer and release cut sheet pieces 17 from the flexible band cross-cutting unit 16 to the shaping station;
- a welding station configured to weld lateral sides of the cut sheet piece after it has been shaped into a container, keeping an upper non-sealed edge; and
- a transfer station 20 adapted to transfer the formed container 2 with an unsealed edge to a line configured for opening said upper non-sealed edge, filling a dosed product into the container 2 and finally closing the upper non-sealed edge of the container.

Fixation of the first functional elements 3 the band 12 can be performed by a welding process either by heat of por ultrasound welding.

As previously indicated according to this invention the shaping station 18 and welding station 19 are arranged along a path of a transport unit 28 that includes a plurality of supporting rods 22, each supporting rod 22 being associated with retention means of the cut sheet pieces 17 forming the container and the transport unit 28 being adapted to move the rods 22 along said path of the transport unit 28 from one to another of the cited shaping station 18 and welding station 19 until reaching the transfer station.

Figure 2:
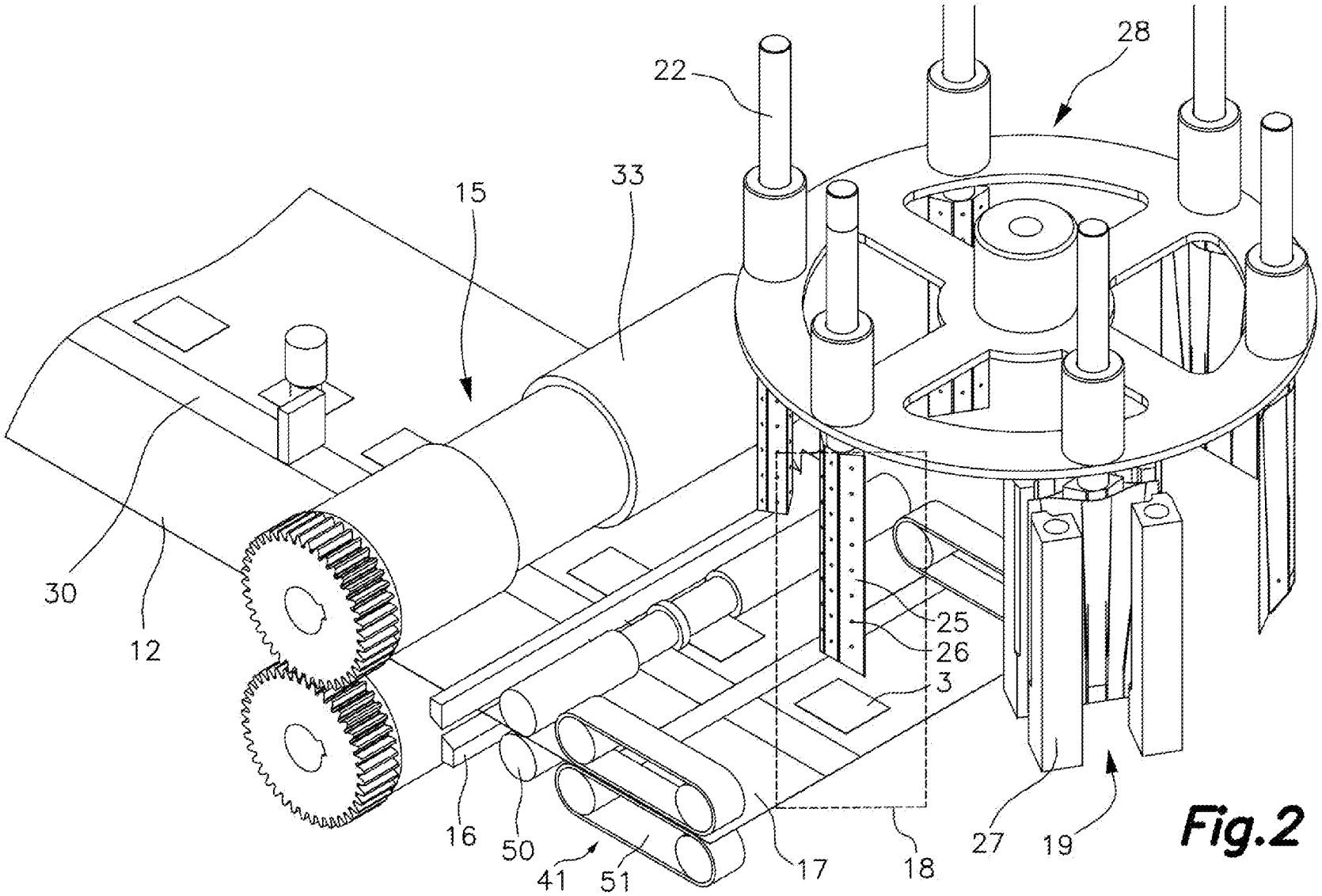
FIG. 2 is a detailed perspective view of an embodiment of the set of cooperating stations configured as a rotary unit for the formation of the container as per the above disclosed.

In the embodiment illustrated in FIGS. 1 and 2 the feeding station 41 comprises a pair of pinch rollers 50 adapted to act on one end portion of the band 12 beyond a pair of cutting members constituting said flexible band cross-cutting unit 16 and two pairs of traction belts 51 adapted to hold opposite end portions of the cut sheet piece 17 and transporting it towards the shaping station 18 by positioning it therein.

Figure 3:
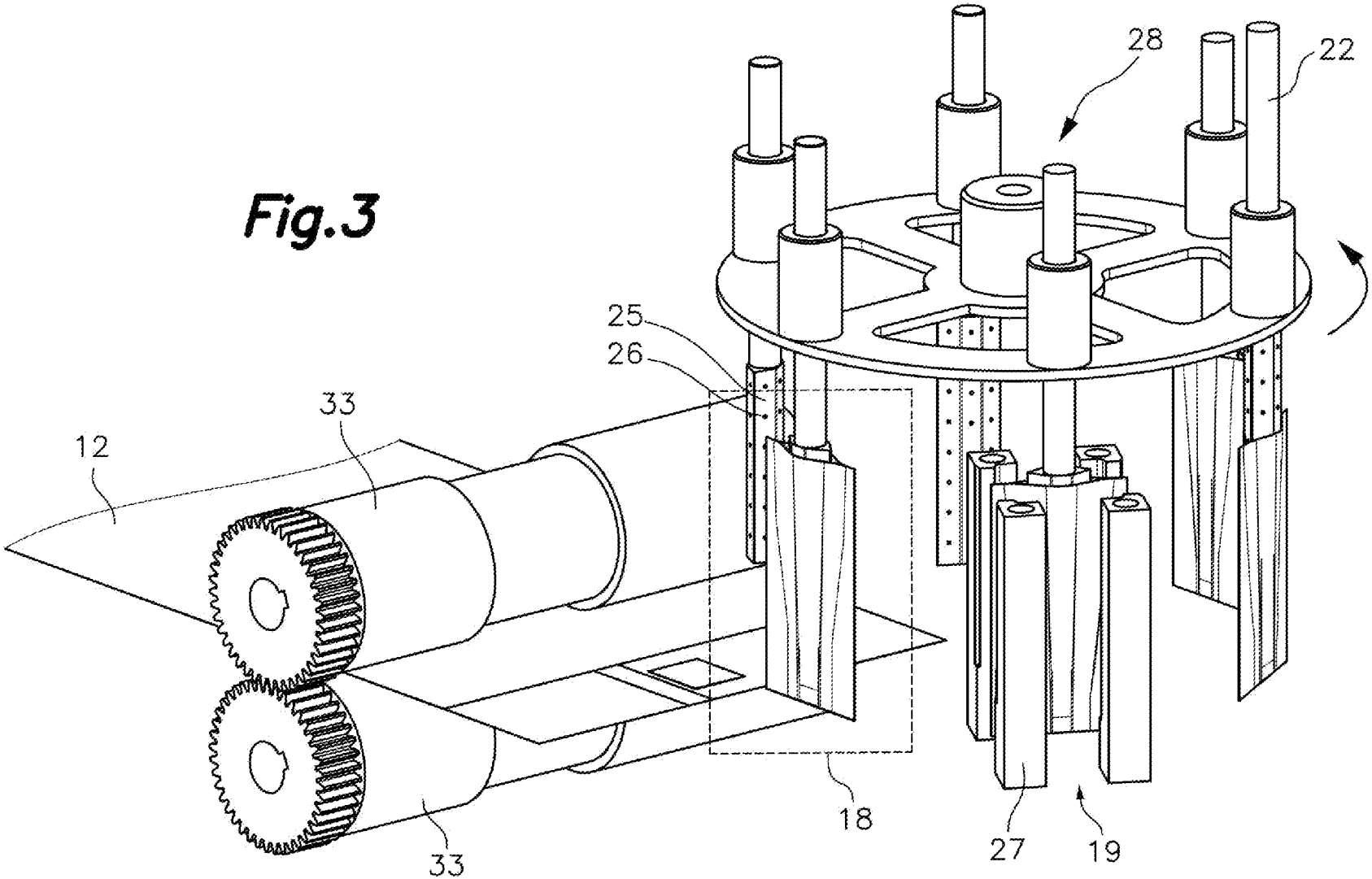
FIG. 3 is equivalent to FIG. 2 but showing the elements of the transport unit at another time of operation.

As illustrated in FIGS. 1 to 3, the shaping station 18 and welding station 19 are arranged along a path of a transport unit 28, that includes a plurality of supporting rods 22, each supporting rod having associated retention means of the cut sheet pieces 17 forming the container and the transport unit being adapted to move the rods 22 along said path from one to another of the cited shaping station 18 and welding station 19 until reaching the transfer station 20.

In the embodiment illustrated in FIGS. 2 and 3 the transport unit 28 is embodied in the form of a rotary unit.

It is also clear from FIGS. 2 and 3 that a portion of the supporting rod 22 is surrounded by a sleeve 25 including a plurality of holes 26 adapted to provide a suction through them to keep a folded cut sheet piece 17—and the subsequently formed container—in correct position in the shaping station and welding station, even during movements of those along the processing.

The shaping of the container entails some operations according to the teaching of the prior art involving folding of the cut sheet piece and at least partially sealing it so that the formed container can subsequently be filled and then closed completely in a filling and sealing station.

In the referred FIGS. 2 and 3 it can be seen that according to a preferred embodiment the transporting unit 28 of machine is embodied as a rotary unit that includes a plurality of supporting rods 22 adapted to move them (supporting the cut sheet pieces 17 that form the container) from one to another of the cited stations 18, 19, 20.

Figure 4:
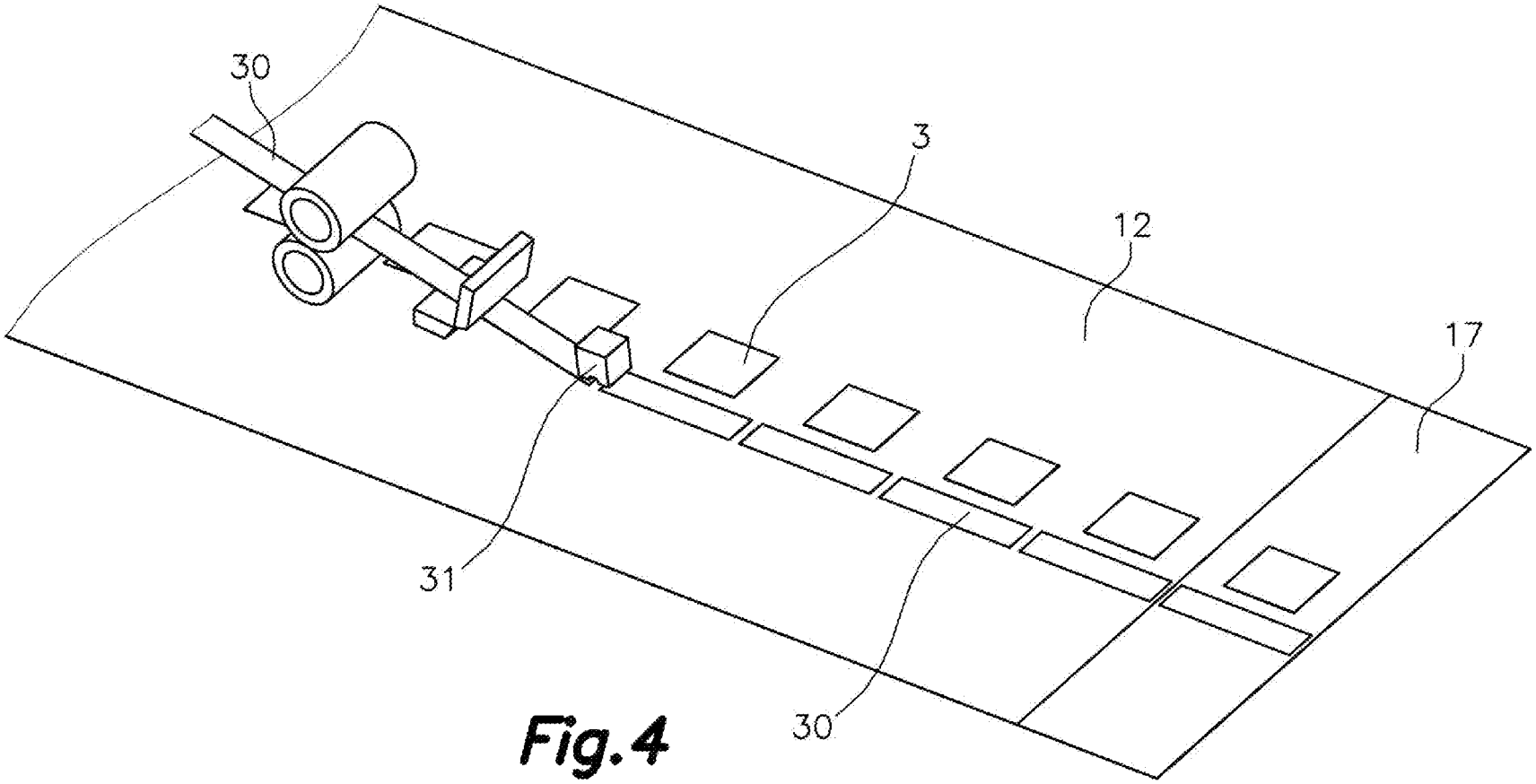
In FIG. 4, a portion of a flexible band has been schematically represented, which receives on it a series of first functional and second functional elements.

As previously indicated in a further embodiment of the proposed machine it comprises a second positioning unit 29 adapted to position on the band 12 second functional elements 30 each of them in a position at a distance of each of the first functional elements 3, and at one side thereof, the machine further including a unit 31 configured to fix each second functional element 30 to the band 12. FIG. 4 shows schematically the arrangement on the band 12 of these second functional elements 30 in the position and at a given distance of first functional elements 3.

As shown in FIG. 1 in an embodiment the feeding unit providing the first functional elements 3 is oriented with a feeding direction transversal to the conveyance direction of the band 12 and the feeding unit providing the second functional elements 30 is oriented in the conveyance direction of the band 12.

As per one embodiment the cited first positioning unit 14 comprises a reel supporting a strip of first functional elements 3 in a roll form which are then separated into units to be applied on the flexible band as outlined in FIG. 1 above.

In a similar way the second positioning unit 29 in an embodiment comprises a continuous strip of second functional elements 30 rolled up into a coil 29 and the unit 31 configured to fix these second functional elements 30 is further adapted (or can include an auxiliar device) to separate second functional elements 30 before fixing them on the flexible band 12.

The line configured for filling a dosed product and closing the non-sealed edge of the container 2 includes a station 34 adapted to open the non-sealed edge of the container 2, a dosing station 35 for filling the container 2 and a closing station 36 comprising welding jaws 37, after which the finished containers 2 are transferred to a storage facility.

As can be seen in FIG. 1 two machines as per the above described can be arranged side by side and connected to a single exit line configured for filling a dosed product into the disclosed container and closing the non-sealed edge of the container.

In a preferred embodiment the machine is connected to a data acquisition system of the operating conditions of the referred stations 18, 19, 20, 29, 34, 35 and 36 enabling the centralization of all these data in a control unit.

The invention claimed is:

1. A machine for automatically manufacturing pouch type containers made of a laminar material sealed at its periphery, the machine comprising:

a flexible band feeding unit adapted to convey a flexible band from a supply roller in a conveyance direction following a conveyance path;

a first positioning unit configured to position on the flexible band first functional elements of the container and arrange these first functional elements in a spaced position relationship along the flexible band, the first positioning unit further including a unit adapted to fix the first functional elements to the flexible band;

a flexible band cross-cutting unit, configured to perform cuts across the flexible band providing cut sheet pieces each including a first functional element;

a shaping station configured to shape a container from each of the cut sheet pieces, the shaping station including a supporting rod that is equipped with retention means that hold a folded cut sheet piece;

a feeding station adapted to transfer and release cut sheet pieces from the flexible band cross-cutting unit to the shaping station;

a welding station configured to weld lateral sides of the cut sheet piece after it has been shaped into a container, keeping an upper non-sealed edge of the container; and a transfer station adapted to transfer said container with said upper non-sealed edge to a line adapted for opening said upper non-sealed edge of the container, filling a dosed product into the container, and closing the upper non-sealed edge of the container;

wherein the shaping station and the welding station are arranged along a path of a transport unit that includes a plurality of supporting rods, the transport unit being adapted to move the supporting rods along said path of the transport unit from one to another of the shaping station and the welding station until reaching the transfer station;

wherein transfer of the cut sheet pieces by the feeding station to the shaping station is synchronized with displacement of the transport unit; and wherein the feeding station comprises a pair of pinch rollers adapted to act on one end portion of the flexible band beyond a pair of cutting members constituting said flexible band cross-cutting unit, and two pairs of traction belts adapted to hold opposite end portions of the cut sheet piece and convey the cut sheet piece to the shaping unit.

2. The machine according to claim 1, wherein a portion of the supporting rod is surrounded by a sleeve including a plurality of holes connected to a vacuum source and adapted to provide a suction through them to provide said retention means that hold the cut sheet piece until the cut sheet piece reaches the transfer station.

3. The machine according to claim 1, further comprising a second positioning unit adapted to position second functional elements on the flexible band, each of the second functional elements being placed in a position that is located at a distance from each of the first functional elements, the machine further including a unit configured to fix each second functional element to the flexible band.

4. The machine according to claim 1, wherein the transport unit is a rotary unit.

5. The machine according to claim 3, further including a pair of overlapping driven rollers by means of which the flexible band with the first functional elements and the second functional elements attached to it is conveyed to the shaping station wedged between said pair of overlapping driven rollers.

6. The machine according to claim 1, wherein the unit adapted to fix the first functional elements to the flexible band includes heat or ultrasonic welding means.

7. The machine according to claim 3, wherein the unit configured to fix the second functional elements to the flexible band includes heat or ultrasonic welding means.

8. The machine according to claim 1, wherein said first positioning unit comprises a strip of the first functional elements oriented transversally to the conveyance direction of the flexible band.

9. The machine according to claim 3, wherein said second positioning unit comprises a strip of the second functional elements oriented in the conveyance direction of the flexible band.

10. The machine according to claim 1, wherein the line includes a station adapted to open said upper non-sealed edge, a dosing station for filling the container, and a closing station comprising welding jaws.

11. The machine according to claim 1, wherein the machine is connected to a data acquisition system adapted to capture operating conditions of the shaping station, the welding station, and the transfer station and enable centralization of all the operating conditions in a control unit.

12. An assembly including at least two machines according to claim 1 connected to a single exit line configured for filling a dosed product into a container and closing an upper non-sealed edge of the container.

* * * * *